US005521888A

United States Patent [19]

Fransen

[11] Patent Number: 5,521,888

[45] Date of Patent: May 28, 1996

[54] CLOCK HAVING A SUSPENDED DIAL TRAIN WITH PIVOTALLY COUPLED ARBORS

[76] Inventor: Lawrence J. Fransen, 1727 Broadlee Trail, Annapolis, Md. 21401

[21] Appl. No.: 450,669

[22] Filed: May 30, 1995

[51] Int. Cl.[6] ..... G04B 19/02

[52] U.S. Cl. ..... 368/220; 368/223; 368/316; 368/76; 368/88

[58] Field of Search ..... 368/220, 223, 368/316, 317, 124, 76, 88

[56] References Cited

U.S. PATENT DOCUMENTS

| | | | |
|---|---|---|---|
| 2,730,913 | 1/1956 | Friedman | 368/220 |
| 4,455,094 | 6/1984 | Russell | 368/65 |
| 4,763,311 | 8/1988 | Marvosh | 368/223 |
| 4,953,149 | 8/1990 | Marvosh | 368/223 |
| 4,995,021 | 2/1991 | Sullivan | 368/233 |
| 5,105,398 | 4/1992 | Hayakawa et al. | 368/238 |

FOREIGN PATENT DOCUMENTS

| | | | |
|---|---|---|---|
| 420330 | 10/1925 | Germany | 368/220 |

*Primary Examiner*—Bernard Roskoski

[57] ABSTRACT

A dial train of a clock is suspended by a plurality of lines. The arbors of the dial train are pivotally coupled permitting the dial train shape to change as the suspension is altered. These new features result in a dial train that is hung rather than placed which permits the dial train to be viewed and enjoyed from a completely new perspective.

20 Claims, 10 Drawing Sheets

CLOCK HAVING A SUSPENDED DIAL TRAIN WITH PIVOTALLY COUPLED ARBORS

BACKGROUND OF THE INVENTION

1. Field of the Invention

This invention relates in general to clocks and in particular to a suspension for a dial train of a clock with pivotally coupled arbors, for displaying time.

2. Description of the Related Art

The enjoyment of a dial train of a clock is derived from the exposure and movement of the seemingly complicated arrangement of gears and arbors. The standard method of support for a dial train is with a frame that rests on a shelf or floor. Dial trains can also be supported with a frame attached to a wall. Supporting a dial train with a shelf, floor, or wall restricts the design and placement. Also, the standard dial train frame is rigid which constricts the dial train to a single shape.

No clock is known that has a suspended dial train. Further, no clock is known that has arbors in the dial train that are pivotally coupled permitting the shape of the dial train to change as the suspension is altered. These new features result in a dial train that can be hung.

SUMMARY OF THE INVENTION

An object of this invention is to provide a means for suspending a dial train of a clock.

It is also an object of the present invention to permit the shape of the dial train to change as the suspension is altered. The reconfiguration of the dial train shape is accomplished by having adjoining arbors pivotally coupled.

BRIEF DESCRIPTION OF THE DRAWINGS

The drawings illustrate embodiments of the present invention in which.

DESCRIPTION OF THE PREFERRED EMBODIMENTS

Now, the first embodiment of the invention will be described with reference to the drawings.

Figure 1:
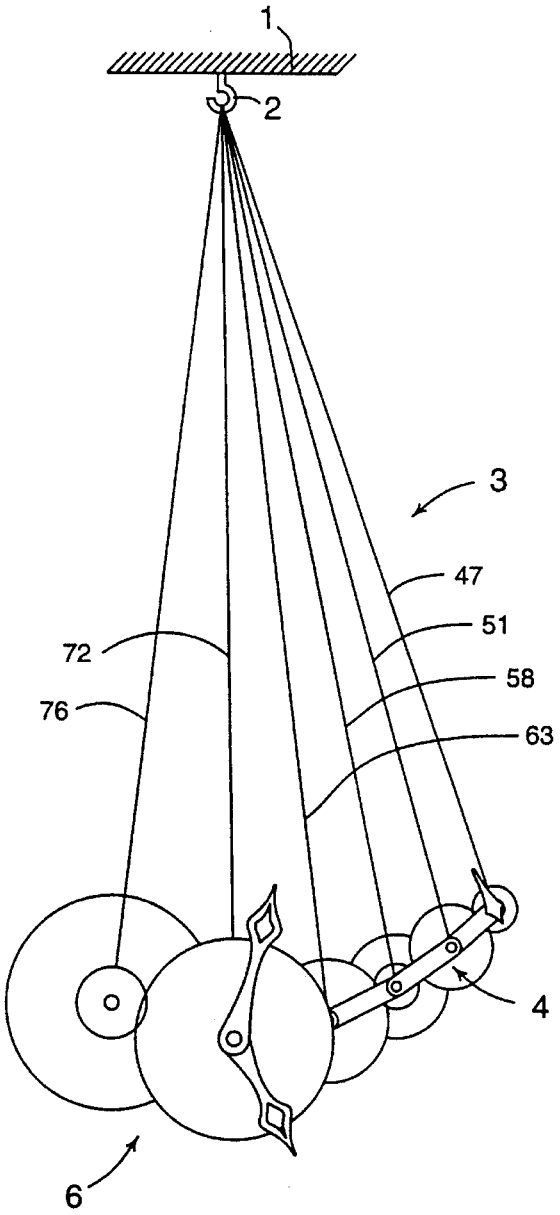
FIG. 1 is a front view of a first embodiment illustrating a suspended dial train of a clock with pivotally coupled dial train rods.
Figure 2:
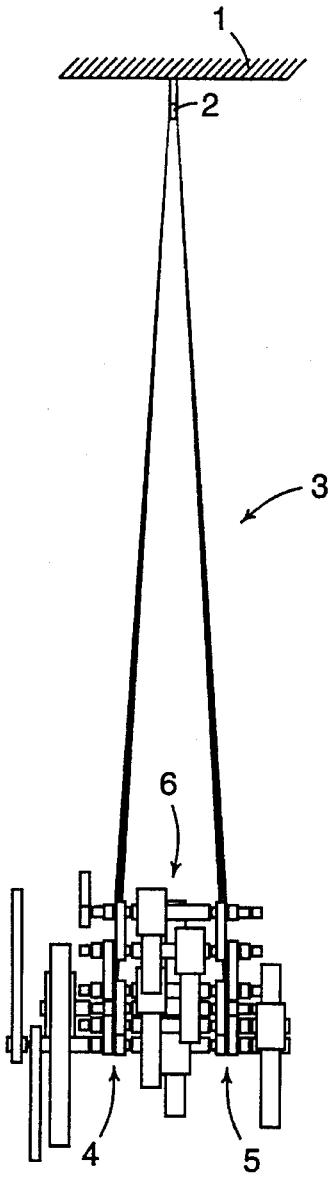
FIG. 2 is a side view of the suspended dial train looking right to left of FIG. 1.

FIGS. 1 and 2 show an overall view of a clock with a suspended dial train. A hook 2 is secured to a support 1. One or more chains, shafts, or lines 3 suspends a front spacer assembly 4 and a back spacer assembly 5. Front and back spacer assemblies 4 and 5 uphold a dial train 6.

Figure 3:
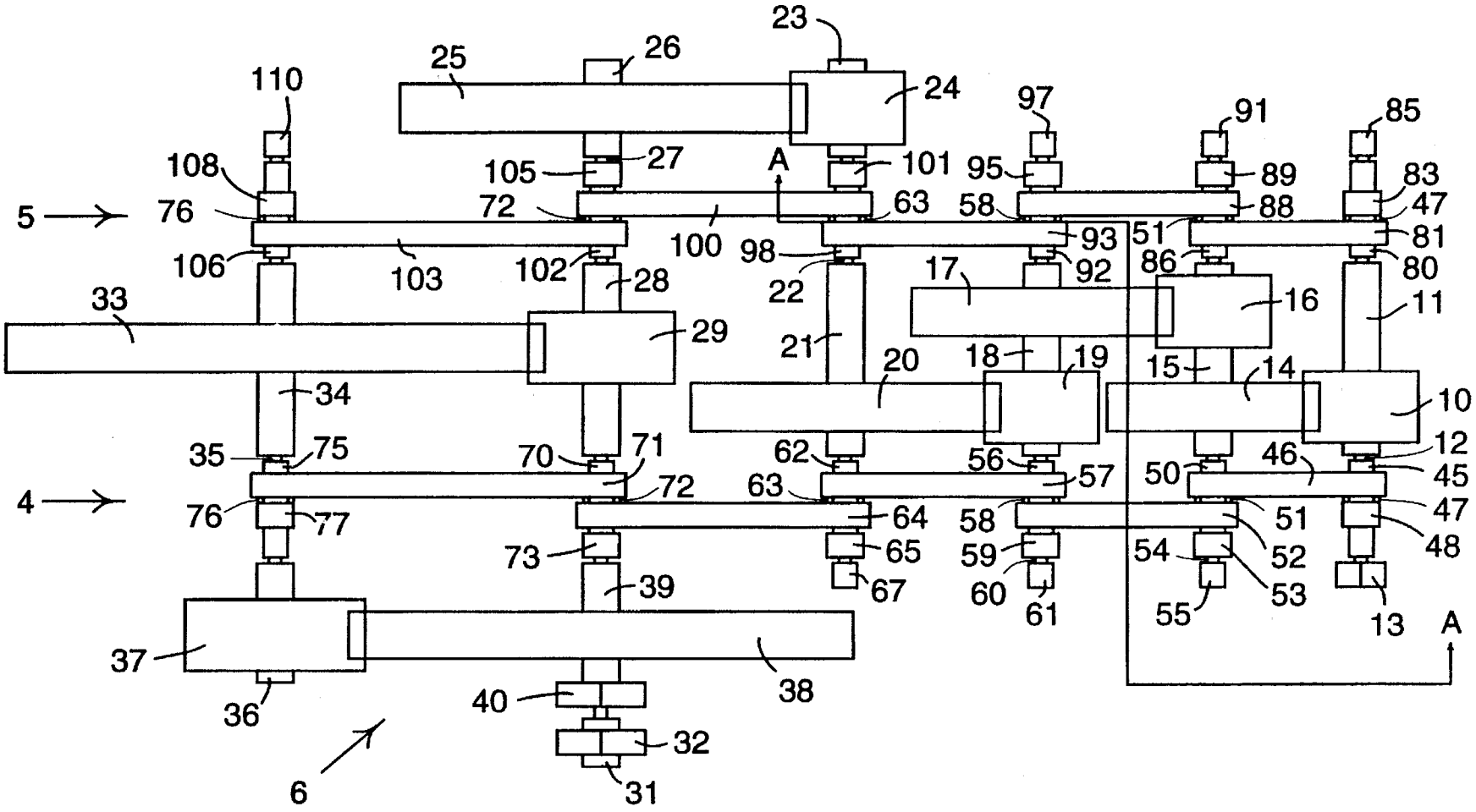
FIG. 3 is a top view of a dial train with dial train rods positioned in a horizontal axial plane.

As illustrated in FIG. 3, a progression of gears achieves a 60-to-1 speed reduction from a second hand 13 to a minute hand 32. This progression of gears has a power supply (not shown) that drives a 12-tooth second pinion 10 in a 1 rpm clockwise direction. Pinion 10 is secured to an arbor 11, and arbor 11 is secured to a dial train rod 12. Rod 12 extends through a bearing 45 for securing to second hand 13. Pinion 10 engages a 24-tooth wheel 14 that is secured to an arbor 15. A 12-tooth pinion 16 is also secured to arbor 15. Pinion 16 engages a 30-tooth wheel 17 that is secured to an arbor 18. A 12-tooth pinion 19 is also secured to arbor 18. Pinion 19 engages a 36-tooth wheel 20 that is secured to an arbor 21. Arbor 21 is secured to a dial train rod 22. Rod 22 extends through a bearing 98 for securing to an arbor 23. A 12-tooth pinion 24 is secured to arbor 23. Pinion 24 engages a 48-tooth minute wheel 25 that is secured to an arbor 26. Arbor 26 is secured to a dial train rod 27 that extends through a bearing 102 for securing to an arbor 28. Rod 27 extends through a bearing 70 for securing to an arbor 31 that carries minute hand 32.

FIG. 3 also illustrates a progression of gears that achieves a 12-to-1 speed reduction from minute hand 32 to an hour hand 40. A 16-tooth pinion 29 is secured to arbor 28 that rotates once per hour. Pinion 29 engages a 64-tooth wheel 33 that is secured to an arbor 34. Arbor 34 is secured to a dial train rod 35 that passes through a bearing 75 for securing to an arbor 36. A 20-tooth pinion 37 is secured to arbor 36. Pinion 37 engages a 60-tooth hour wheel 38 that is secured to an arbor 39 that is allowed to rotate freely about rod 27. Hour hand 40 is secured to arbor 39 that rotates once every 12 hours.

FIG. 3 shows dial train 6 with pinions engaging wheels that result in a decrease of speed at each successive arbor in the dial train. This gear down drive, where pinions drive wheels, permits one tooth profile for all the gears. All the gears in dial train 6 can be cut with an involute gear profile. While FIG. 3 shows the dial train 6 using standard involute gear profile teeth on the pinions and wheels, other ratio drive mechanisms can be used, for example: sprockets and chain, and timing belt pulleys and timing belts.

The journals of rod 12 turn in bearings 45 and 80. The journals of dial train rod 54 turn in bearings 50 and 86. The journals of dial train rod 60 turn in bearings 56 and 92. The journals of rod 22 turn in bearings 62 and 98. The journals of rod 27 turn in bearings 70 and 102. The journals of rod 35 turn in bearings 75 and 106.

A clock's moving parts must be held in precise alignment with each other. FIG. 3 shows front spacer assembly 4 that has bearings 45 and 50 secured to a spacer 46, bearings 56 and 62 secured to a spacer 57, and bearings 70 and 75 secured to a spacer 71. The two holes in spacer 52 serve as bearings to permit the journals of bearings 50 and 56 to rotate in spacer 52. The two holes in spacer 64 serve as bearings to permit the journals of bearings 62 and 70 to rotate in spacer 64. Bearing collars 53, 59, 65, and 73 are placed on their respective bearings 50, 56, 62, and 70 to allow spacers 52 and 64 to rotate freely yet be retained on the bearings.

FIG. 3 also shows back spacer assembly 5 that has bearings 80 and 86 secured to a spacer 81, bearings 92 and 98 secured to a spacer 93, and bearings 102 and 106 secured to a spacer 103. The two holes in spacer 88 serve as bearings to permit the journals of bearings 86 and 92 to rotate in spacer 88. The two holes in spacer 100 serve as bearings to permit the journals of bearings 98 and 102 to rotate in spacer 100. Bearing collars 89, 95, 101, and 105 are placed on their respective bearings 86, 92, 98, and 102 to allow spacers 88 and 100 to rotate freely yet be retained on the bearings.

Bearing collars 48, 53, 59, 65, 73, 77, 83, 89, 95, 101, 105, and 108 are made to fit snugly over bearings 45, 50, 56, 62, 70, 75, 80, 86, 92, 98, 102, and 106. The snug fit prevents the need to glue or otherwise permanently secure bearing collars. This type of construction enables easy disassemble of the front and back spacer assemblies 4 and 5.

FIGS. 1–3 illustrate the union of dial train 6 with front spacer assembly 4. Rod 12 is prevented from disengagement from front spacer assembly 4 by second hand 13 that is secured to rod 12. Rods 54, 60, and 22 are prevented from disengagement from front spacer assembly 4 by rod collars 55, 61, and 67 secured to their respective rods 54, 60, and 22. Rod 27 is prevented from disengagement from front spacer assembly 4 by arbor 30 that is secured to rod 27. Rod 35 is prevented from disengagement from front spacer assembly 4 by arbor 36 that is secured to rod 35.

FIGS. 2 and 3 illustrate the union of dial train 6 with back spacer assembly 5. Rods 12, 54, 60, and 35 are prevented from disengagement from back spacer assembly 5 by rod collars 85, 91, 97, and 110 secured to their respective rods 12, 54, 60, and 35. Rod 22 is prevented from disengagement from back spacer assembly 5 by arbor 23 that is secured to rod 22. Rod 27 is prevented from disengagement from back spacer assembly 5 by arbor 26 that is secured to rod 27.

Rod collars 55, 61, 67, 85, 91, 97, and 110 are also made to fit snugly over rods 12, 54, 60, 22, and 35. The snug fit prevents the need to glue or otherwise permanently secure rod collars. This type of construction enables easy disassemble of dial train 6 from front and back spacer assemblies 4 and 5.

The construction of the front and back spacer assemblies 4 and 5 pivotally couple adjoining arbors of the dial train 6 to permit the pivoting of one of the adjoining arbors around the other adjoining arbor.

Figure 4:
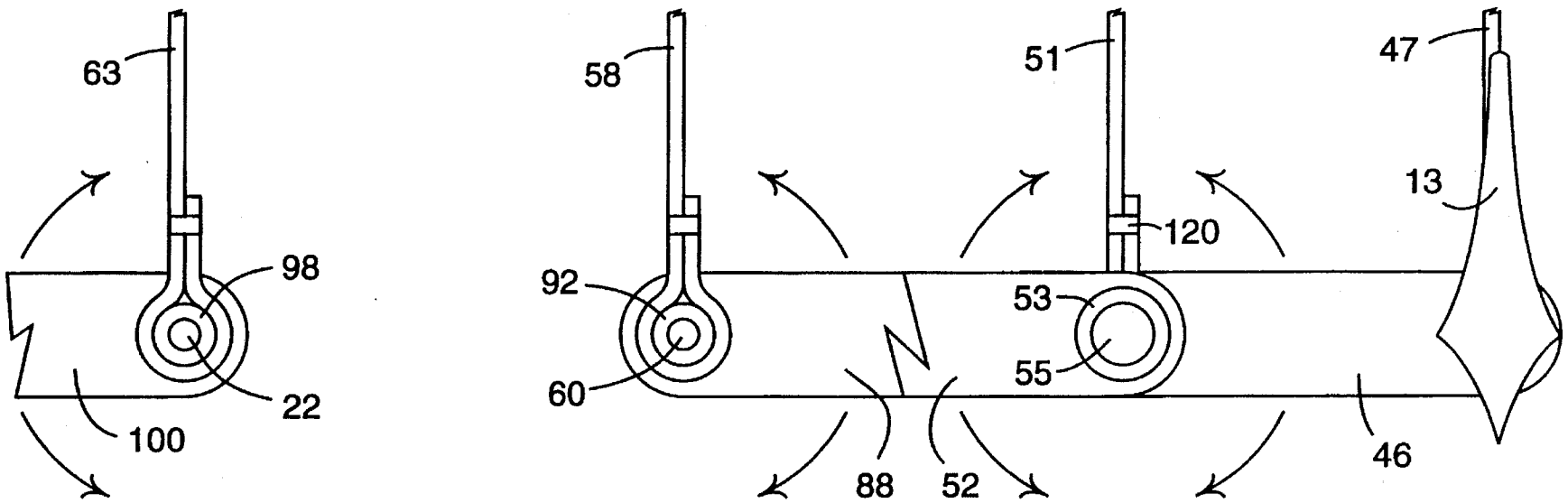
FIG. 4 is a front partial view of the front and back spacer assembly taken along line A—A in FIG. 3.
Figure 5:
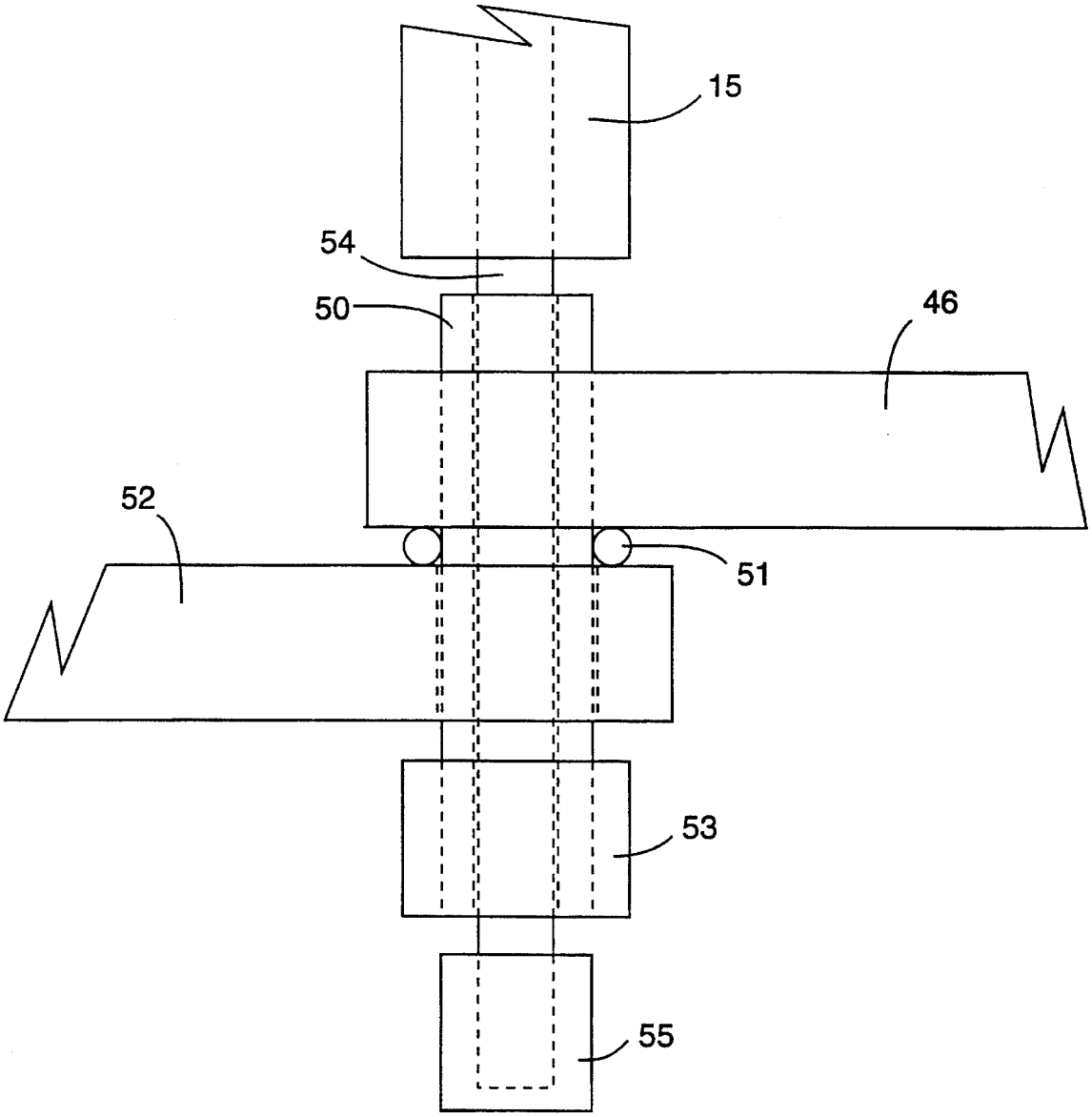
FIG. 5 is a top view of an enlarged bearing assembly.

FIGS. 1–5 illustrate one method for six lines 47, 51, 58, 63, 72, and 76 to suspend the front and back spacer assemblies 4 and 5. Since similar procedures are used to fasten each line, a description for line 51 will illustrate how all six lines are fastened. As shown in FIGS. 4 and 5, one end of line 51 is wrapped around bearing 50 and secured to itself by a band 120. Supporting line 51 is held captive between spacers 46 and 52. From bearing 50, line 51 ascends to hook 2 (shown in FIGS. 1 and 2) and then descends for securing to bearing 86 (shown in FIG. 3). Line 51 can be secured to hook 2 (shown in FIGS. 1 and 2).

To maintain rod alignment, the center of gravity of gears and arbors on each rod should occur between the two supporting bearings. As shown in FIG. 3, special attention must be paid to rods 22, 27, and 35 that have gears outside front and back spacer assemblies 4 and 5. In the case of rod 35, wheel 33 can be positioned on arbor 34 closer to back spacer assembly 5 such that the center of gravity of arbors and gears occurs mid way between bearings 75 and 106. After wheel 33 is secured to arbor 34, pinion 29 can be positioned for securing to arbor 28 on rod 27. Now focusing on rod 27, weight of wheels 38 and 25 are adjusted on their respective arbors 39 and 26 such that the center of gravity of gears and arbors occurs between bearings 70 and 102. Now focusing on rod 22, the relative positions of wheel 20 and pinion 24 cause little difficulty achieving the center of gravity of gears and arbors between bearings 62 and 98.

Now, a second embodiment will be described.

Figure 6:
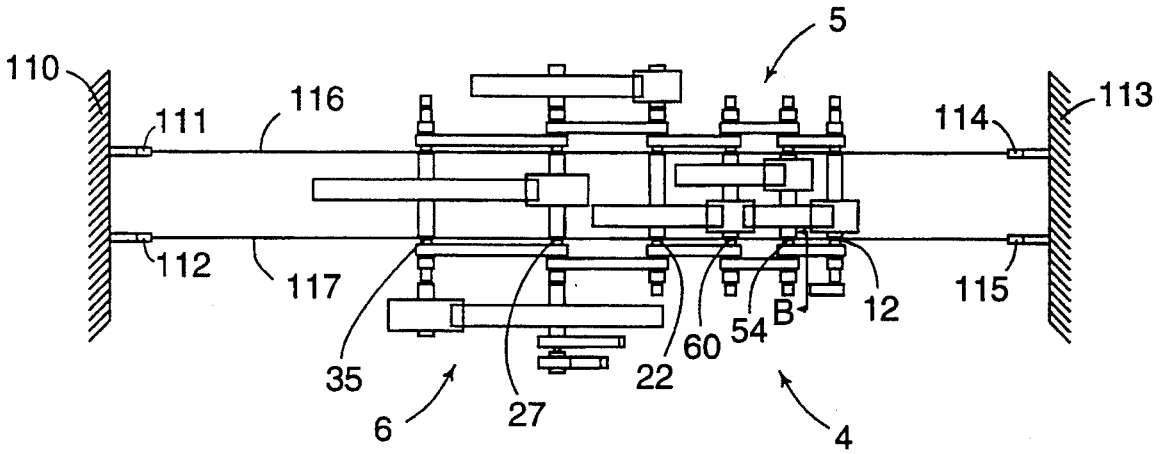
FIG. 6 is a top view of a second embodiment illustrating a suspended dial train of a clock with pivotally coupled dial train rods.
Figure 7:
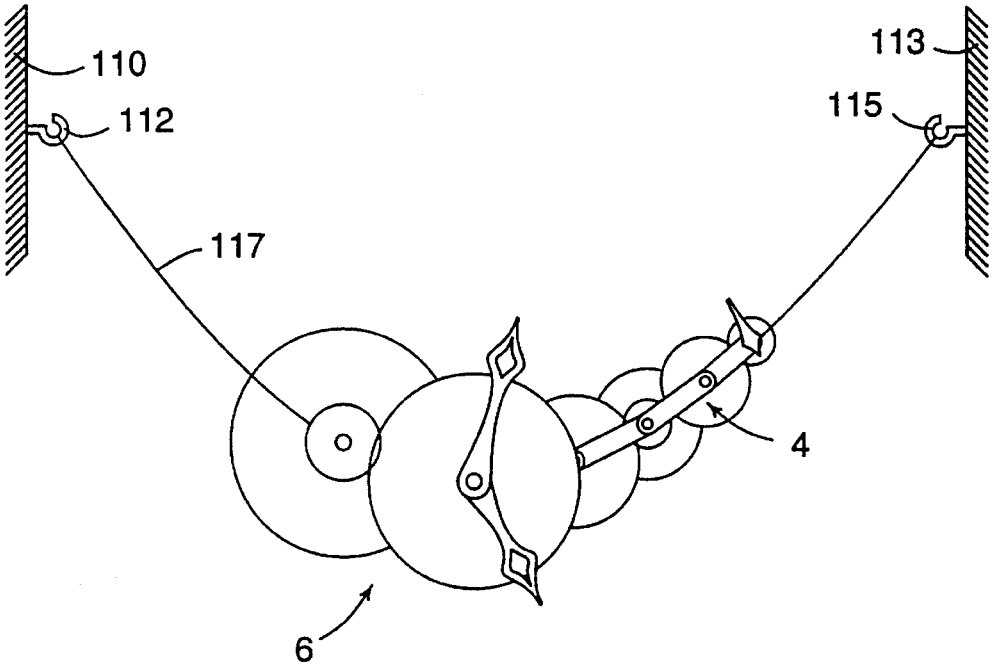
FIG. 7 is a front view of FIG. 6.

FIGS. 6 and 7 show an overall top and front view of a second embodiment. A chain, shaft, or line 117 is fastened to hooks 112 and 115. A chain, shaft, or line 116 is fastened to hooks 111 and 114. Hooks 111 and 112 are secured to a support 110, and hooks 114 and 115 are secured to support 113. It is seen that, rods 12, 54, 60, 22, 27, and 35 rest on lines 117 and 116.

Figure 8:
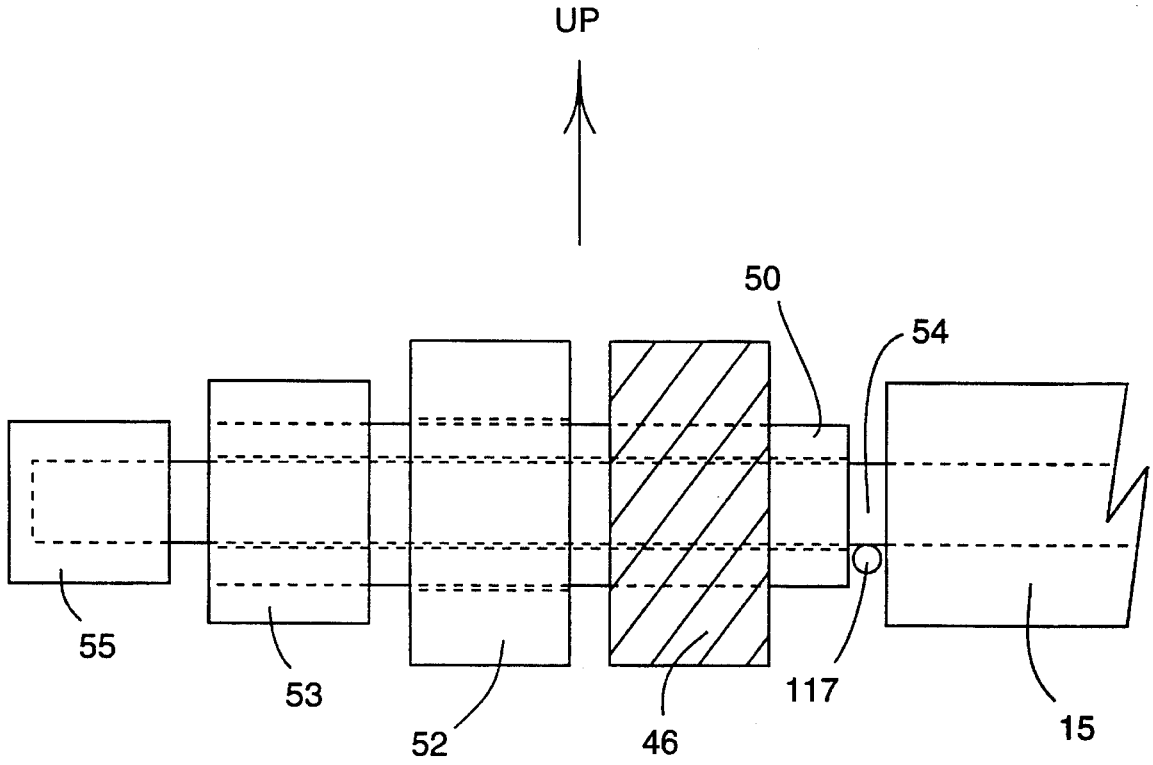
FIG. 8 is a side view of an enlarged bearing assembly taken along line B—B in FIG. 6.

Now referring to FIG. 8, the position where line 117 suspends rod 54 is shown. Rod 54 rests on line 117. Now referring to FIG. 3, line 117 is captured between front spacer assembly 4 and arbors 11, 15, 18, 21, 28, and 34 of dial train 6. Line 116 is captured between back spacer assembly 5 and arbors 11, 15, 18, 21, 28, and 34 of dial train 6. Now referring to FIGS. 6 and 7, dial train 6 is suspended by two lines 116 and 117. Dial train 6 is free to move between hooks 111, 112 and hooks 114, 115.

The relative angles of adjoining spacers 46 and 52, 52 and 57, 57 and 64, 64 and 71 in the front spacer assembly and the relative angles of adjoining spacers 81 and 88, 88 and 93, 93 and 100, 100 and 103 in the back spacer assembly may be adjusted from a horizontal position wherein all of the supporting rods 12, 54, 60, 22, 27, and 35 are in the same axial plane as in FIG. 3 to other arrangements such as seen in FIG. 7. These arrangements are made possible since the gear supporting rods 12, 54, 60, 22, 27, and 35 are rotatably supported in front and back spacer assemblies 4 and 5 which allow the rods freedom of movement. The rods 12, 54, 60, 22, 27, and 35 are movable which allows the distances between non adjoining rods to change. The pivotally coupled rods 12, 54, 60, 22, 27, and 35 allow the shape of the dial train to change as the support or suspension is altered.

Now, a third embodiment will be described.

Figure 9:
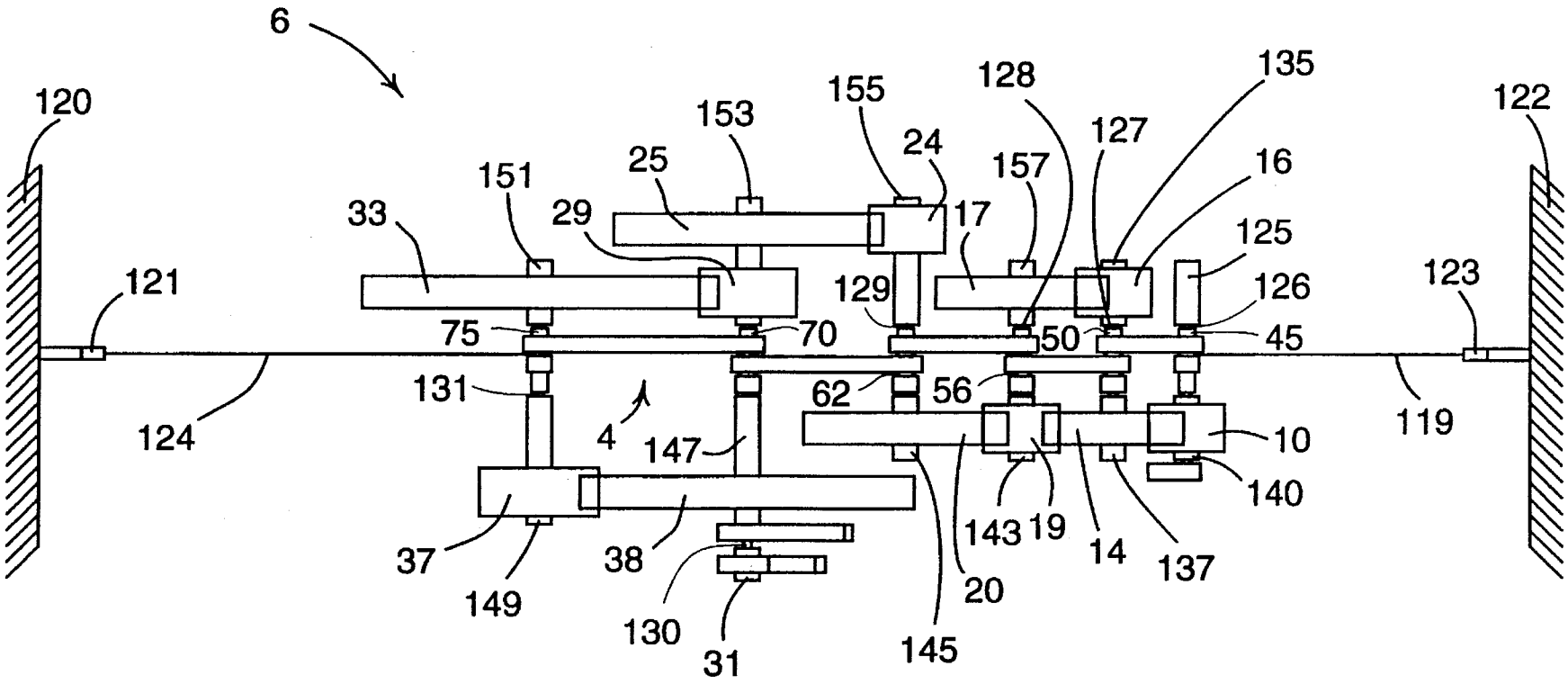
FIG. 9 is a top view of a third embodiment illustrating a suspended dial train of a clock with pivotally coupled dial train rods.
Figure 10:
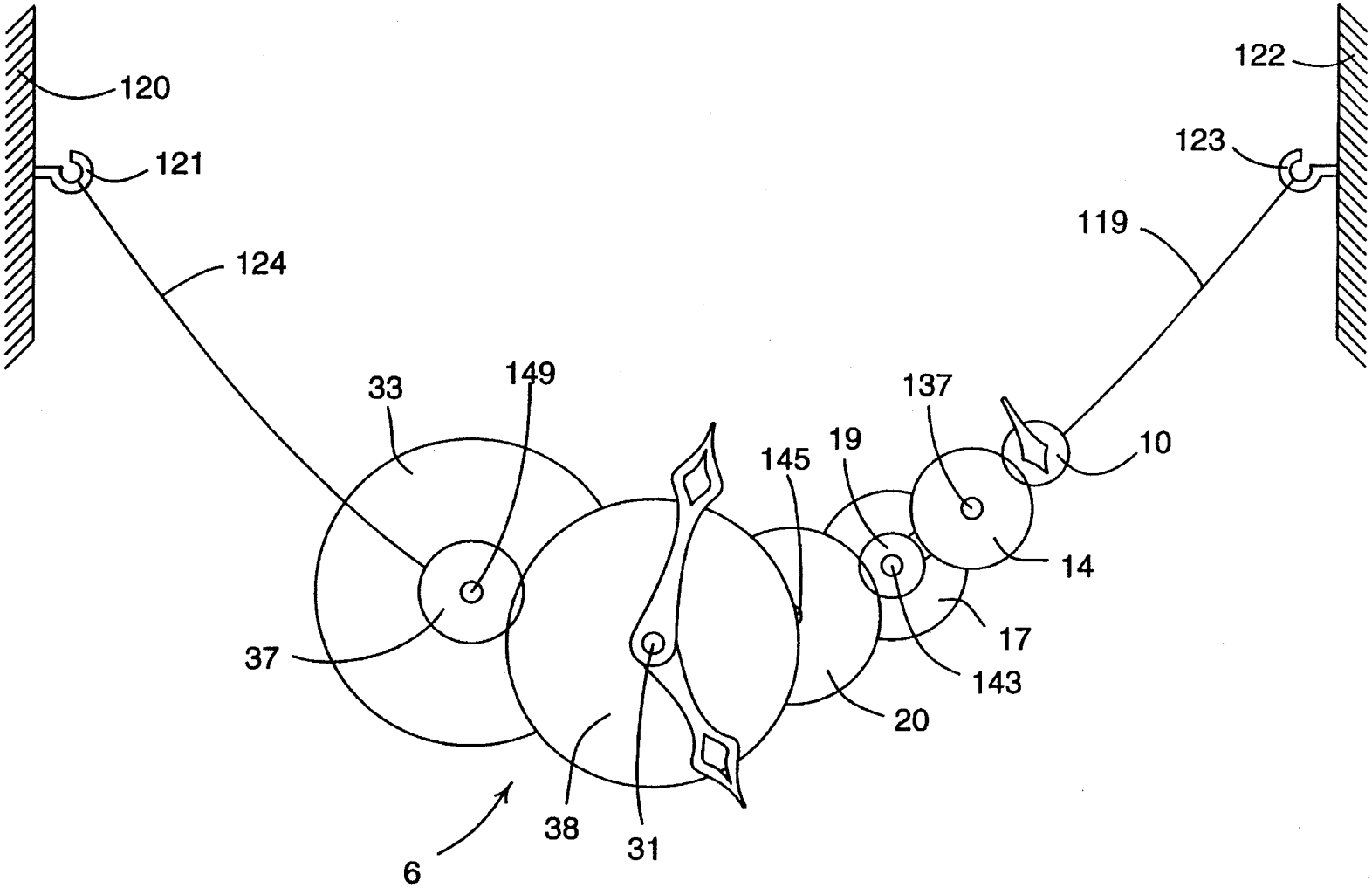
FIG. 10 is a front view of FIG. 9.

FIGS. 9 and 10 illustrate a front spacer assembly 4 upholding a dial train 6. Because the third embodiment is similar in construction to the first and second embodiments, just details that exemplify new aspects will be described in detail.

The gears, engagement of gears, hands, and front spacer assembly 4 of the third embodiment as illustrated in FIGS. 9 and 10 are the same as found in the first and second embodiments as illustrated in FIGS. 1–8. The arbors secured to dial train rods of FIGS. 9 and 10 differ from those secured to their counterparts in FIGS. 1–8. Thus, the dial train rods of the third embodiment have been renumbered. Except for arbor 31, the arbor arrangement of the third embodiment is different from that found in the first and second embodiment. Thus, the arbors have been renumbered except for arbor 31.

Dial train rods 126, 127, 128, 129, 130, and 131 are journaled respectively in bearings 45, 50, 56, 62, 70, and 75 of the front spacer assembly 4. Arbors 140 and 125; 137 and 135; 143 and 157; 145 and 155; 31 and 153; 149 and 151 are secured respectively to rods 126, 127, 128, 129, 130, and 131 preventing the dial train rods from disengaging from front spacer assembly 4.

The 12-tooth pinions 10, 16, 19, and 24 are secured respectively to arbors 140, 135, 143, and 155. The 16-tooth pinion 29 and the 20-tooth pinion 37 are secured respectively to arbors 153 and 149. The 24-tooth wheel 14, 30-tooth wheel 17, 36-tooth wheel 20, 48-tooth wheel 25, 60-tooth wheel 38, and 64-tooth wheel 33 are secured respectively to arbors 137, 157, 145, 153, 147, and 151. Arbor 147 rotates freely about rod 130.

Referring to FIGS. 9 and 10, a hook 121 is secured to support 120, and hook 123 is secured to support 122. Chains, shafts, or lines 124 and 119 suspend a dial train 6. Line 124 is secured to hook 121 and bearing 75, and line 119 is secured to hook 123 and bearing 45.

In FIG. 9, consideration must be given to the distribution of weight secured to each rod 126, 127, 128, 129, 130, and 131 such that the center of gravity of each rod assembly is near respectively the mid point between ends of bearings 45, 50, 56, 62, 70, and 75.

The gear supporting rods 126, 127, 128, 129, 130, and 131 are rotatably supported in front spacer assembly 4 which allows the rods freedom of movement. The rods 126, 127, 128, 129, 130, and 131 are movable which allows the distances between non adjoining rods to change. The pivotally coupled rods 126, 127, 128, 129, 130, and 131 allow the shape of the dial train to change as the support or suspension is altered.

Now, a fourth embodiment will be described.

Figure 11:
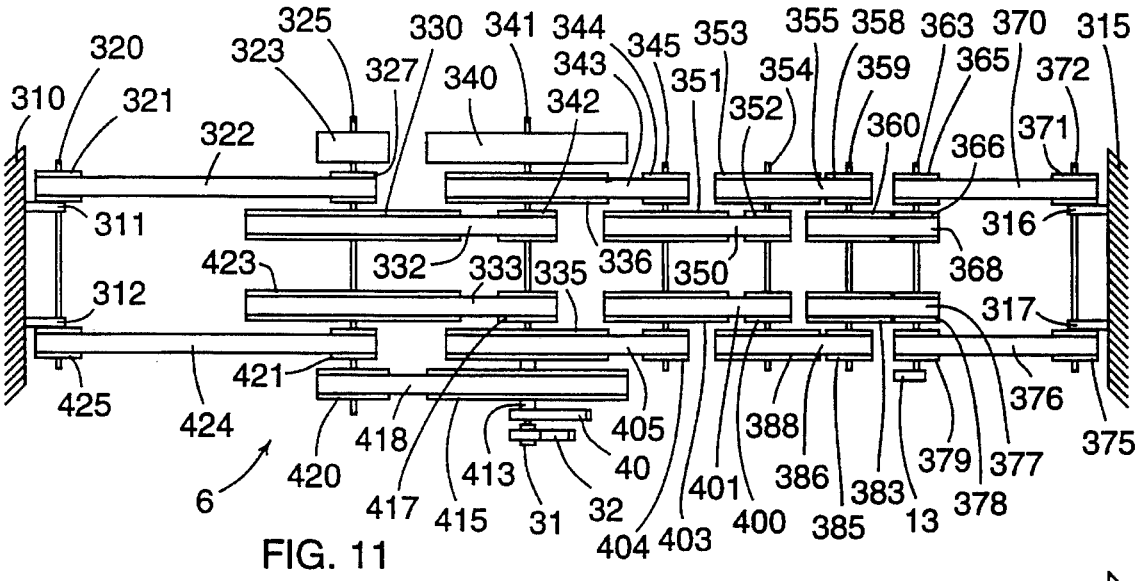
FIG. 11 is a top view of a fourth embodiment illustrating a suspended dial train of a clock with pivotally coupled dial train rods.
Figure 12:
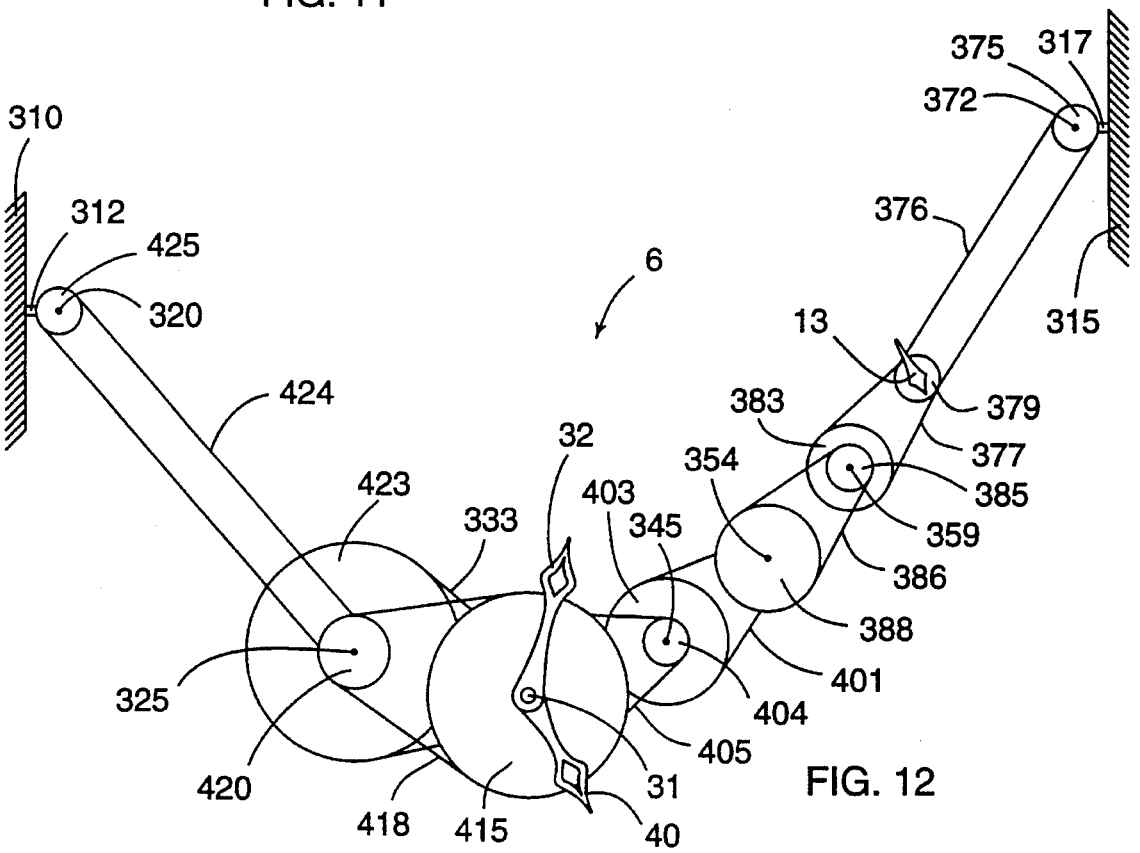
FIG. 12 is a front view of FIG. 11.
Figure 13:
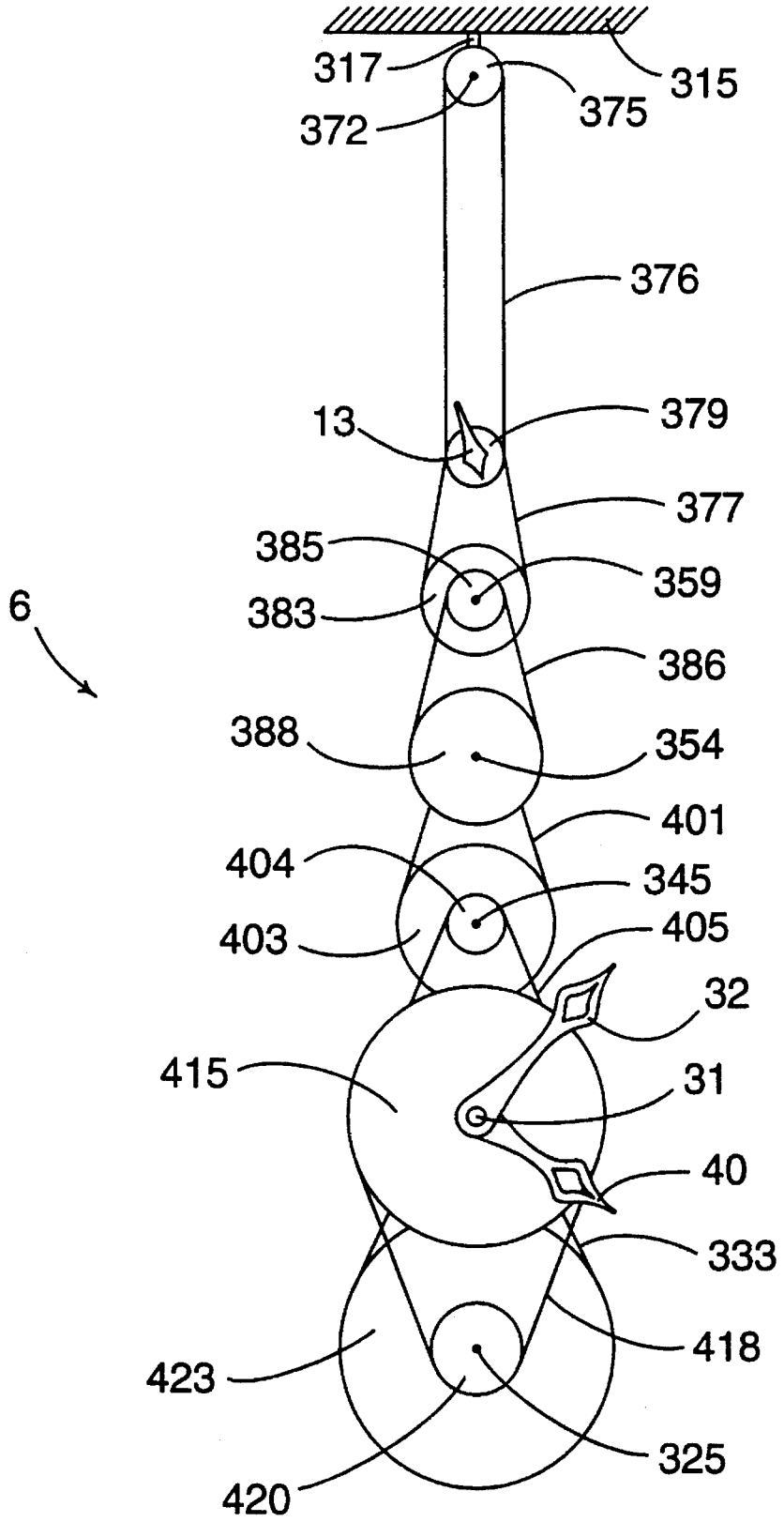
FIG. 13 illustrates a means for suspending the dial train of FIG. 12. with the dial train rods positioned in a vertical axial plane.

FIGS. 11–13 illustrate a suspended dial train 6 that is driven synchronously. The synchronous drive can be by means of a flexible timing chain and sprocket and/or a flexible timing belt and grooved pulley. The remainder of the description will refer only to timing belt and grooved pulley.

As illustrated in FIG. 11, a progression of timing belts and grooved pulleys achieves a 60-to-1 speed reduction from a second hand 13 to a minute hand 32 and a 12-to-1 speed reduction from minute hand 32 to an hour hand 40. Twelve-groove pulleys 375 and 371 are secured to a shaft 372 which is journaled in bearings 317 and 316. Bearings 317 and 316 are secured to support 315. A power supply (not shown) drives shaft 372 in a 1 rpm clockwise direction. By means of timing belts 376 and 370, 12-groove pulleys 379 and 365 rotate in a 1 rpm clockwise direction. Pulleys 379 and 365 and second hand 13 are secured to a dial train rod 363. As well, 12-groove pulleys 378 and 366 are secured to rod 363. By means of timing belts 377 and 368, 24-groove pulleys 383 and 360 rotate. Pulleys 383 and 360 are secured to a dial train rod 359. As well, 12-groove pulleys 385 and 358 are secured to rod 359. By means of timing belts 386 and 355, 30-groove pulleys 388 and 353 rotate. Pulleys 388 and 353 are secured to a dial train rod 354. As well, 12-groove pulleys 400 and 352 are secured to rod 354. By means of timing belts 401 and 350, 36-groove pulleys 403 and 351 rotate. Pulleys 403 and 351 are secured to a dial train rod 345. As well, 12-groove pulleys 404 and 344 are secured to rod 345. By means of timing belts 405 and 343, 48-groove pulleys 335 and 336 rotate. Pulleys 335 and 336 are secured to a dial train rod 341 which rotates once every hour. Minute hand 32 is secured to an arbor 31 which is secured to rod 341. As well, 16-groove pulleys 417 and 342 are secured to rod 341. By means of timing belts 333 and 332, 64-groove pulleys 423 and 330 rotate. Pulleys 423 and 330 are secured to a dial train rod 325. As well, 12-groove pulleys 421 and 327 are secured to rod 325. By means of timing belts 424 and 322, 12-groove pulleys 425 and 321 rotate. Pulleys 425 and 321 are secured to a shaft 320. Shaft 320 is journaled in bearings 312 and 311. Bearings 312 and 311 are secured to a support 310. A 20-groove pulley 420 is secured to rod 325. A 60-groove pulley 415 is secured to an arbor 413 that rotates freely about rod 341. Timing belt 418 rotates pulley 415 once every 12 hours. Hour hand 40 is secured to arbor 413.

A single timing belt of sufficient width to maintain rod alignment can replace the double belts 377 and 368. In a like manner, a single belt can replace 401 and 350, and 333 and 332.

Rods 325, 341, 345, 354, 359, and 363 are maintained in proper alignment by the addition of a 20-groove pulley weight 323 secured to rod 325 and a 60-groove pulley weight 340 secured to rod 341. Weight 323 is positioned such that the center of gravity of rod 325, pulleys 420, 421, 423, 330, 327, and weight 323 is near the mid point between the ends of rod 325. Weight 340 is positioned such that the center of gravity of rod 341, pulleys 415, 335, 417, 342, 336, arbors 31 and 413, minute hand 32, hour hand 40, and weight 340 is near the mid point between the ends of rod 341.

Referring to FIGS. 11–13, the axial planes of adjoining rods 325, 341, 345, 354, 359, and 363 may be adjusted from a vertical position as shown in FIG. 13 to other arrangements such as seen in FIG. 12. These arrangements are made possible since rods 325, 341, 345, 354, 359, and 363 are rotatably supported by belts 424, 322, 333, 332, 405, 343, 401, 350, 386, 355, 377, 368, 376, and 370 which allow the rods freedom of movement. The rods 325, 341, 345, 354, 359, and 363 are movable which allows the distances between non adjoining rods to change. In the vertical position shown in FIG. 13, belts 424 and 322 (shown in FIGS. 11 and 12) are not necessary. The pivotally coupled rods 325, 341, 345, 354, 359, and 363 allow the shape of the dial train to change as the support or suspension is altered. The shape of the dial train can also be changed by replacing belts with smaller or larger belts. Installing smaller or larger belts can change the distances between adjoining rods 325 and 341, 341 and 345, 345 and 354, 354 and 359, and 359 and 363.

The foregoing description of the preferred and alternate embodiments of the invention have been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What I claim is:

1. A drive and suspension apparatus for a clock comprising:

a support means;

a flexible suspension means hanging from said support means;

at least one dial train rod supported by said flexible suspension means;

said flexible suspension means rotates said at least one dial train rod; and a means for displaying time supported by said at least one dial train rod.

2. The apparatus according to claim 1, wherein:

said flexible suspension means further comprises a plurality of dial train rods, said plurality of dial train rods comprising said at least one dial train rod and a second dial train rod; and said at least one dial train rod is pivotally coupled to said second dial train rod.

3. The apparatus according to claim 1, wherein:

said support means is spaced apart to uphold said flexible suspension means.

4. The apparatus according to claim 1, wherein:

said support means further comprises at least one synchronous drive member.

5. The apparatus according to claim 1, wherein:

said flexible suspension means further comprises at least one synchronous drive member.

6. A drive and suspension apparatus for a clock comprising:

a support means;

a flexible suspension means hanging from said support means;

a plurality of dial train rods comprising at least a first dial train rod and a second dial train rod, said plurality of dial train rods supported by said flexible suspension means, said first dial train rod and said second dial train rod having a distance between said first dial train rod and said second dial train rod, wherein said first dial train rod and said second dial train rod are movable to change said distance;

a drive means for rotating said plurality of dial train rods; and a means for displaying time supported by said plurality of dial train rods.

7. The apparatus according to claim 6, wherein:

said flexible suspension means rotates at least one of said plurality of dial train rods.

8. The apparatus according to claim 7, wherein:

said flexible suspension means further comprises at least one synchronous drive member.

9. The apparatus according to claim 6, wherein:

said support means is spaced apart to uphold said flexible suspension means.

10. A drive and suspension apparatus for a clock comprising:

a support means, said support means is spaced apart;

a flexible suspension means hanging from said support means;

a plurality of dial train rods comprising at least a first dial train rod and a second dial train rod, said plurality of dial train rods supported by said flexible suspension means, said first dial train rod is pivotally coupled to said second dial train rod;

a drive means for rotating said plurality of dial train rods; and a means for displaying time supported by said plurality of dial train rods.

11. The apparatus according to claim 10, wherein:

said flexible suspension means further comprises at least one flexible member.

12. The apparatus according to claim 10, wherein:

said flexible suspension means rotates at least one of said plurality of dial train rods.

13. The apparatus according to claim 12, wherein:

said flexible suspension means further comprises at least one synchronous drive member.

14. A drive and suspension apparatus for a clock comprising:

a support means;

a flexible suspension means hanging from said support means;

at least three dial train rods comprising at least a first dial train rod and a second dial train rod, said at least three dial train rods supported by said flexible suspension means, said first dial train rod is pivotally coupled to said second dial train rod;

a drive means for rotating said at least three dial train rods; and a means for displaying time supported by said at least three dial train rods.

15. The apparatus according to claim 14, wherein:

said flexible suspension means further comprises at least one flexible member.

16. The apparatus according to claim 14, wherein:

said flexible suspension means rotates at least one of said at least three dial train rods.

17. The apparatus according to claim 16, wherein:

said flexible suspension means further comprises at least one synchronous drive member.

18. A drive and suspension apparatus for a clock comprising:

a support means;

a suspension means comprising a flexible suspension means and a plurality of dial train rods; said plurality of dial train rods comprising at least a first dial train rod and a second dial train rod, said suspension means hanging from said support means;

a drive means for rotating said plurality of dial train rods;

a means for displaying time supported by said plurality of dial train rods; and removal of said first dial train rod will cause said second dial train rod to fall.

19. The apparatus according to claim 18, wherein:

said suspension means further comprises at least one flexible member.

20. The apparatus according to claim 19, wherein:

said flexible member rotates at least one of said plurality of dial train rods.

* * * * *

UNITED STATES PATENT AND TRADEMARK OFFICE

CERTIFICATE OF CORRECTION

PATENT NO. : 5,521,888
DATED : May 28, 1996
INVENTOR(S) : Lawrence J. Fransen

It is certified that error appears in the above-indentified patent and that said Letters Patent is hereby corrected as shown below:

Column 3, line 30, change " arbor 30 " to -- arbor 31 --.

Signed and Sealed this

Sixth Day of August, 1996

Bruce Lehman

*Attest:*

BRUCE LEHMAN

*Attesting Officer*

*Commissioner of Patents and Trademarks*